United States Patent [19]

Newell et al.

[11] Patent Number: 4,974,735

[45] Date of Patent: Dec. 4, 1990

[54] CLOSURE

[76] Inventors: Robert E. Newell; Paul K. Rand, both of Glaxo Group Research Ltd., Park Road, Ware, Hertfordshire SG12 ODG, United Kingdom

[21] Appl. No.: 474,269

[22] Filed: Feb. 2, 1990

[30] Foreign Application Priority Data

Feb. 3, 1989 [GB] United Kingdom ..... 8902384

[51] Int. Cl.[5] ..... B65D 41/32

[52] U.S. Cl. ..... 215/253; 215/250; 215/235; 215/237; 220/239; 220/265; 220/266

[58] Field of Search ..... 215/250, 251, 253, 256, 215/258, 235, 236, 237, 245, 204, 224; 220/239, 265, 266, 268, 276

[56] References Cited

U.S. PATENT DOCUMENTS

| | | | |
|---|---|---|---|
| 3,651,992 | 3/1972 | Hazard | 222/153 |
| 4,361,244 | 11/1982 | Walter | 215/253 |
| 4,487,324 | 12/1984 | Ostrowsky | 215/253 |
| 4,709,823 | 12/1987 | Beck et al. | 215/235 |
| 4,747,498 | 5/1988 | Gach | 215/232 |
| 4,787,526 | 11/1988 | Pehr | 215/216 |
| 4,795,044 | 1/1989 | Beck | 215/237 |
| 4,809,874 | 3/1989 | Pehr | 220/338 |
| 4,815,618 | 3/1989 | Gach | 215/232 |
| 4,860,907 | 8/1989 | Sondal | 215/230 |
| 4,919,286 | 4/1990 | Agbay, Sr. | 215/235 |

*Primary Examiner*—Stephen Marcus
*Assistant Examiner*—Stephen Cronin
*Attorney, Agent, or Firm*—Darby & Darby

[57] ABSTRACT

The application describes a closure for a container, the closure comprising a first part to be mounted on the container and a second part pivotally connected to the first part to close upon the first part. First tamper-evident means are provided between the two parts and a catch is provided on one of the parts. The catch is movable between a first neutral position and a second position in which it can connect with the other part, the catch in its second position forming second tamper-evident means. The catch is preferably provided on the second part and it is pivotable between its said two positions.

10 Claims, 10 Drawing Sheets

CLOSURE

BACKGROUND OF THE INVENTION

This invention relates to a tamper-evident closure.

Many types of such closures are known. Their purpose is to ensure that once a closure has been opened it cannot then be re-closed without it being apparent that it has previously been opened. Such closures are widely used in connection with containers for products such as medicines or foods to prevent interference with the contents of the containers after they have been closed by the original manufacturer and packer.

The invention more specifically relates to a doubly tamper-evident closure. By this it is meant a closure which, after opening, can be re-closed, with it being evident whether the closure is in its initial condition, or whether it has been opened once and re-closed, or whether it has been opened after re-closure. By way of example, one context where a doubly tamper-evident closure would be desirable is in the case of certain pharmaceutical products which may be supplied by the manufacturer to a user, such as a hospital, in one form (e.g. as a powder) and which are then converted by the user to a second form (for example converted to a solution by adding water) to be stored for subsequent administration to patients. This is the case, for example, with certain antibiotics. In such a case it would be desirable for the container initially to be tamper-evident so that the hospital knows that the container it receives has not been tampered with on its way from the manufacturer, and then, after the container has been opened, water added, and the container re-closed, for it again to be tamper-evident so that a nurse or other person administering the solution to a patient knows that the solution has not been tampered with since it was originally prepared.

The invention particularly concerns a closure of the type which consists of two parts, one being pivotally or hingedly connected to the other. Closures of this type which are singly tamper-evident are well known, for example from U.S. Pat. Nos. 4,815,618 and 4,838,441. Another closure of this type is known from U.S. Pat. No. 4,795,044, this closure including a first tamper indicating device between one part and the container to which the closure is fitted, and a second tamper-evident device between the two parts, the second tamper evident device being in the form of a locking ring which is hingedly connected to the said one part. However, this closure is not doubly tamper-evident as between the two parts thereof. The first tamper-evident device relates only to the connection between the closure and the container.

BRIEF SUMMARY OF THE INVENTION

According to the present invention, there is provided a closure for a container, the closure comprising a first part to be mounted on the container and a second part pivotally connected to the first part, wherein first tamper-evident means are provided between the two parts and wherein a catch is provided on one of the parts, the catch being movable relative to the said one part between a first position in which it does not connect with the other part and a second position in which it can connect with the other part, the catch in its second position forming second tamper-evident means.

Advantageously, the catch is provided on the second part and is pivotable between its two positions. The catch may comprise a breakable locking arm, as may the first tamper-evident means. Alternatively, the first tamper-evident means may comprise a breakable membrane between the two parts of the closure.

Preferred embodiments of the invention are described in detail below, by example only.

BRIEF DESCRIPTION OF THE DRAWINGS

FIG. 1*a* showing the closure in the condition which it occupies before placement on a product containing vial, FIG. 1*b* showing the closure on the vial in its first unopened condition, FIG. 1*c* showing the closure opened, FIG. 1*d* showing the closure re-closed and FIG. 1*e* showing the closure re-opened;

DETAILED DESCRIPTION

Figure 2:
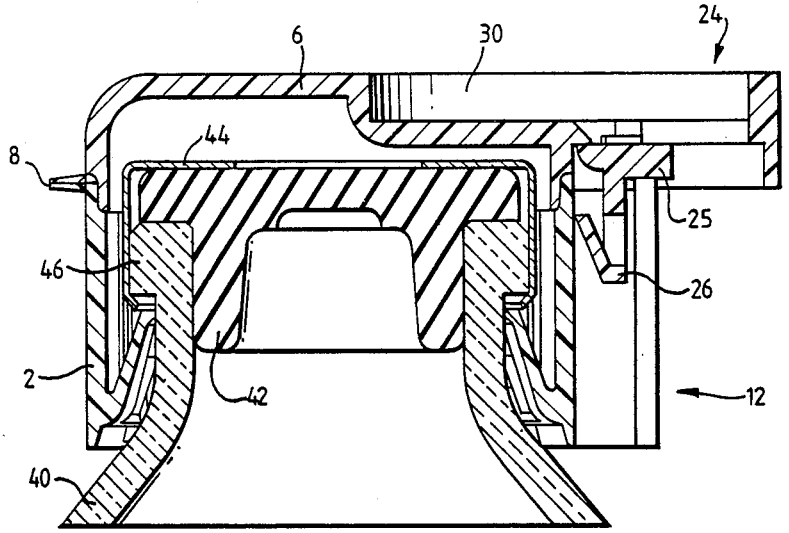
FIG. 2 is a vertical section on a larger scale showing the closure in the condition of FIG. 1*d;*

Referring first to FIG. 2, this illustrates a glass vial 40 the upper end of which has an opening which is closed by a rubber bung 42 over which an aluminum alloy overseal 44 is provided. The closure according to this embodiment of the present invention is mounted over the conventional closure constituted by elements 42 and 44.

The closure illustrated more clearly in FIG. 1*a* to 1*e* comprises a collar 2 terminating at its lower end in an integral upwardly and inwardly directed ring 4 formed of several circumferential sections. A cap 6 is connected to the collar 2 by an integral hinge 8. Where the hinge 8 joins the collar 2, two generally vertical lines of weakness 10 are provided in the collar 2. On the side of the collar 2 remote from the hinge there is provided a female locking portion 12 defined by a rear wall 14, two side walls 16, and an upper wall 18. The wall 18 has a slot 20 extending parallel to the axis of the hinge 8 and a pair of slots 22 extending perpendicular to the axis of the hinge 8.

The cap 6 carries a male locking member 24. This comprises a generally L-shaped locking element 25 pivotally mounted in an aperture in the locking member 24 by a membrane-like hinge 27. The locking element 25 has a locking arm 26 extending perpendicular to the axis of the hinge 8. The locking member 24 further comprises a pair of spaced apart locking arms 28 extending perpendicular to the plane of cap 6 and arranged on either side of the locking element 25. The locking arms 28 are connected to the cap 6 via weak bridges 29. Both the locking arm 26 and the locking arms 28 have hooks or barbs at their ends to engage in slots 20 and 22. In this embodiment, broadly speaking the locking arms 28 provide the first tamper-evident means and the locking arm 26 the second.

Figure 1A:
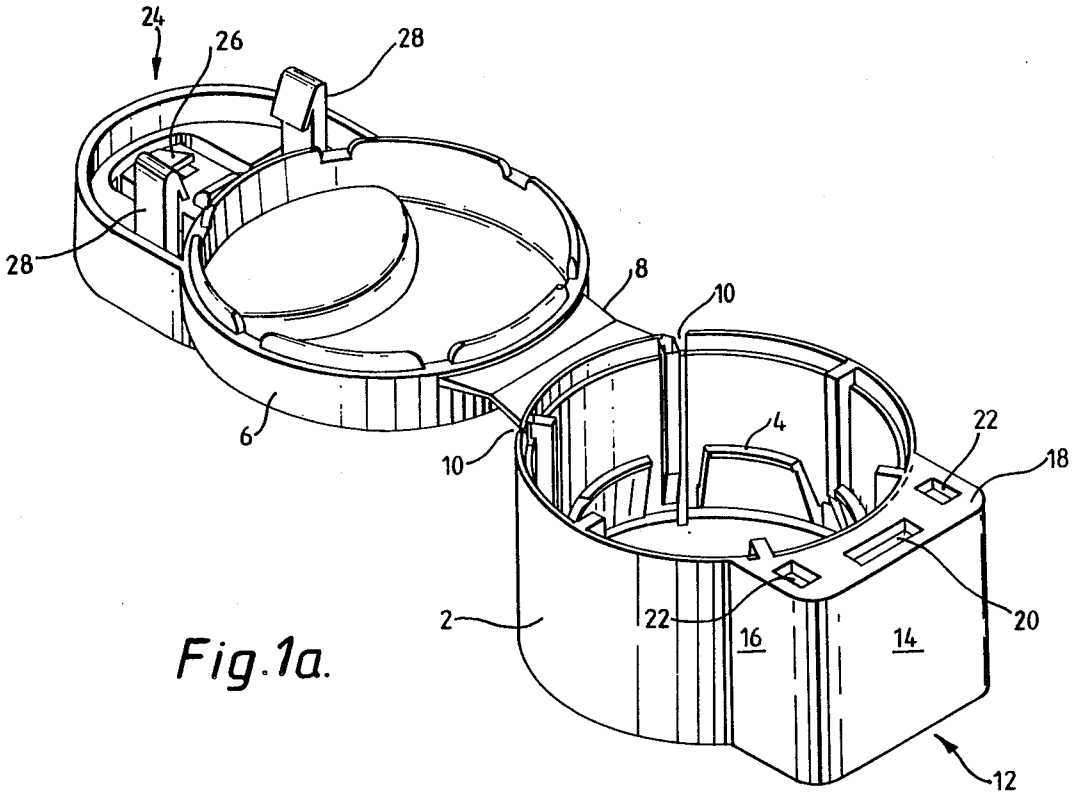
FIGS. 1*a* to 1*e* are perspective views of a first embodiment.
Figure 2A:
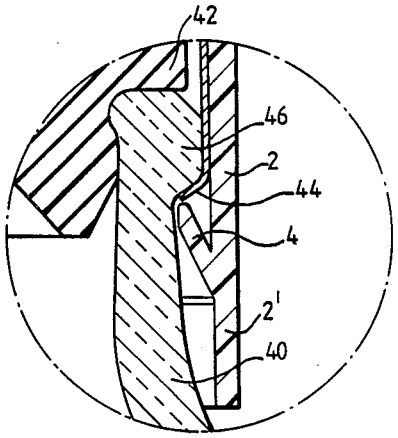
FIGS. 2*a* and 2*b* show, on a still larger scale, details of alternative forms of the closure portion in FIG. 2.
Figure 2B:
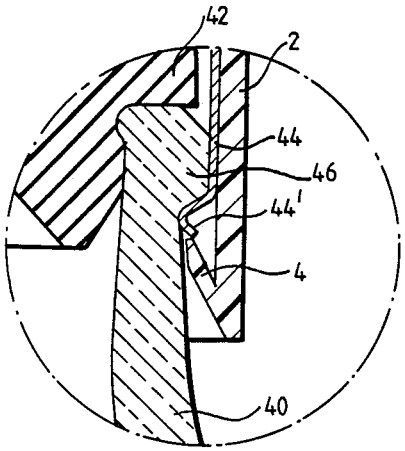

The closure is moulded in the open condition shown in FIG. 1*a*. The closure is made of polyethylene, for example. The closure is applied to the vial 40 by pushing the collar 2 down over the neck of the vial, so that the inward edge of the ring 4 engages beneath an outwardly directed annular bead 46 provided on the upper edge of the vial. The closure cannot thereafter be removed intact FIGS. 2*a* and 2*b* show two modifications of the way in which the ring 4 co-operates with the vial. In FIG. 2*a* the collar 2 is provided with an additional portion 2' which extends integrally downwardly below the ring 4. This is intended to reduce the possibility that someone might seek to insert some kind of instrument between the ring 4 and the vial 40 so as to lever the closure off the vial. In the modification of FIG. 2*b* the overseal 44 is provided with a return portion 44' beneath which the upper edge of the ring 4 can engage. Once again the purpose is to make it still more difficult for anyone to remove the closure illicitly from the vial.

Figure 1B:
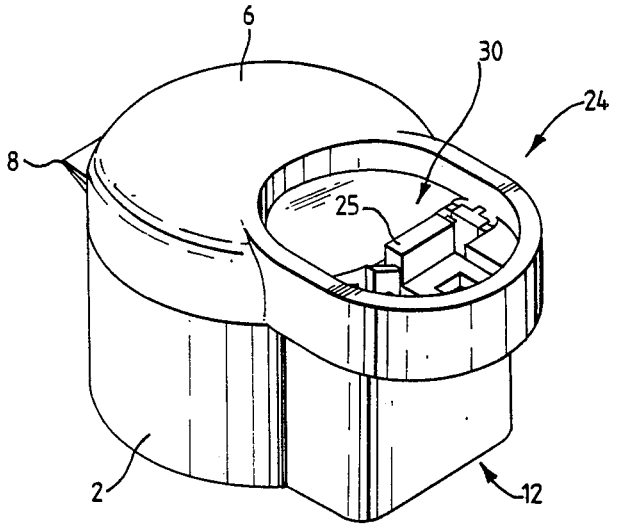

Either before or after the closure is applied to the vial it is closed for the first time to bring it into the condition shown in FIG. 1*b*. In this condition the arms 28 are snap fit into slots 22, and the cap 6 covers the upper end of the collar 2. The arm 26 lies parallel to the upper surface of the cap 6 and does not perform any locking function at this stage.

Figure 1D:
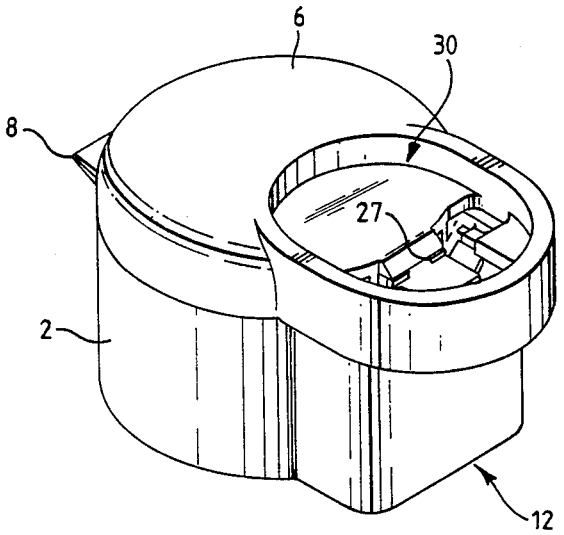
Figure 1C:
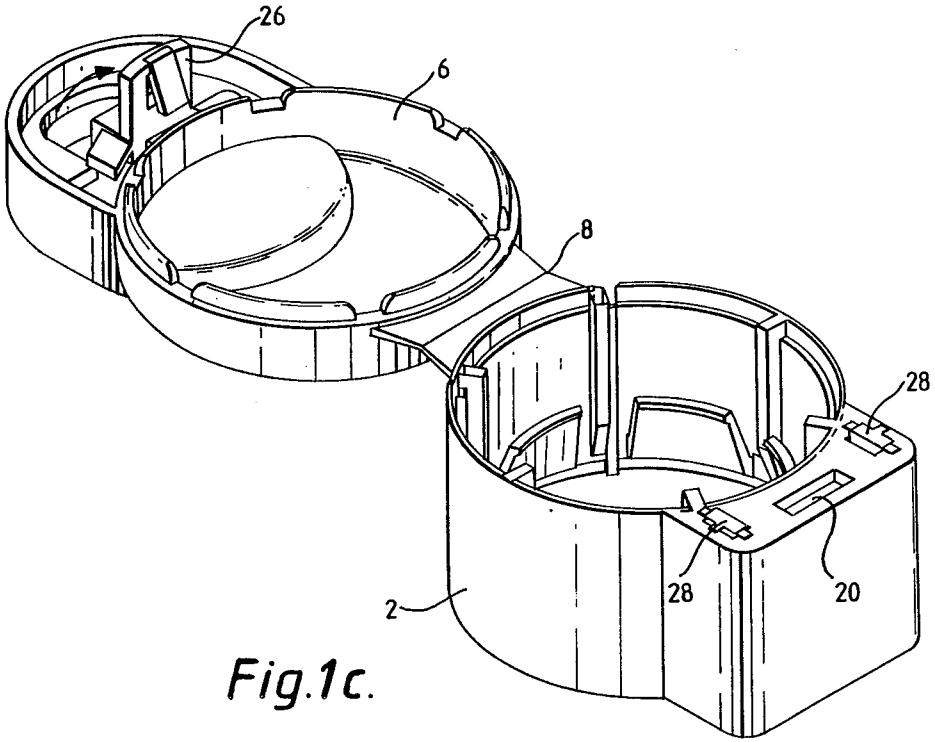

When it is desired to open the closure for the first time the user grasps the male locking member 24 and pulls upwardly, which causes the locking arms 28 to break, leaving them still engaged in the slots 22. The resulting tamper-evident condition is shown in FIG. 1*c*.

When it is desired to re-close the closure the locking element 25 is pivoted about its hinge 27 to bring it into a position in which the locking arm 26 extends upwardly, perpendicular to the plane of the cap 6. This pivotal movement is indicated by an arrow in FIG. 1*c*, in which figure the locking element 25 is shown in the position into which it has been pivoted. The pivotal movement may be achieved by movement of a user's thumb in an oval recess 30 in the cap 6, the aperture for the locking element 25 being at one end of the recess. The foot of the L-shaped locking element 25 protrudes into the recess before being pivoted and so is easily displaced by the user's thumb. The cap 6 is then pivoted about the hinge 8 to cause the arm 26 to snap into the slot 20. This second closed condition is shown in FIG. 1*d* and in FIG. 2.

Figure 1E:
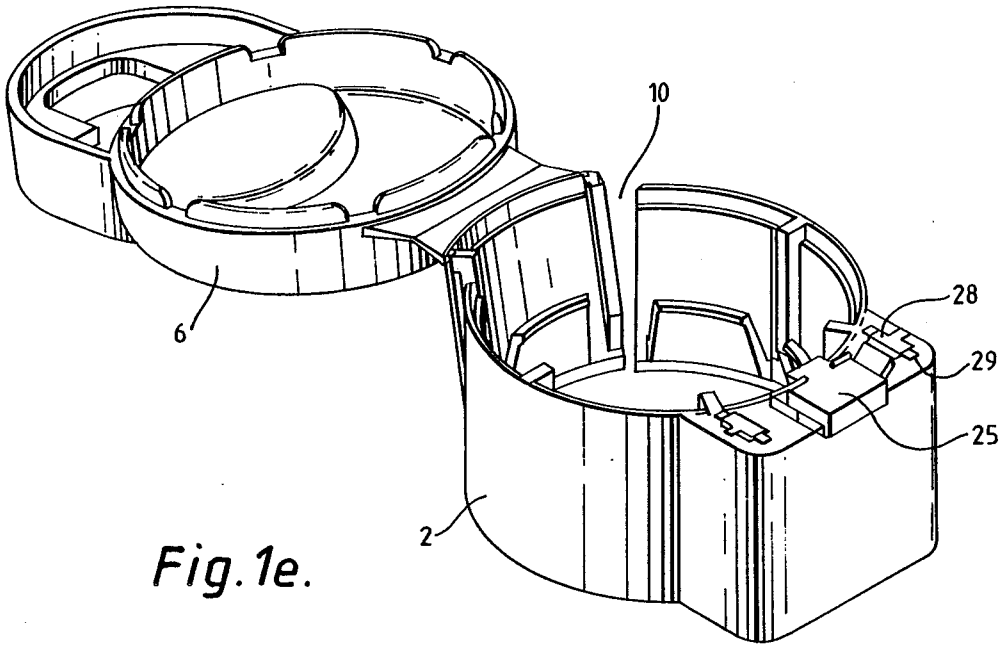

When it is desired to open the closure for a second time the user grasps the male locking member 24 and pulls it upwardly. This causes the locking element 25 to break along hinge 27 leaving the locking element 25 still engaged in the slot 20. This second tamper-evident condition is shown in FIG. 1*e*. If it is desired then to remove the closure completely from the vial a downward force is exerted on the cap 6 to cause the collar 2 to fracture along the vertical lines of weakness 10. This is shown in the course of the progress in FIG. 1*e*. Completion of the process causes an entire section of the collar 2 to come away with the cap 6, so that the remaining portion of the collar 2 can simply be removed from the neck of the vial. This leaves the vial readily accessible by the user, for example to enable the vial-/overseal assembly to be connected to administration equipment. An alternative to providing two complete lines of weakness 10 would be to form the collar 2 of two sections connected to one another by frangible ribs.

Figure 3A:
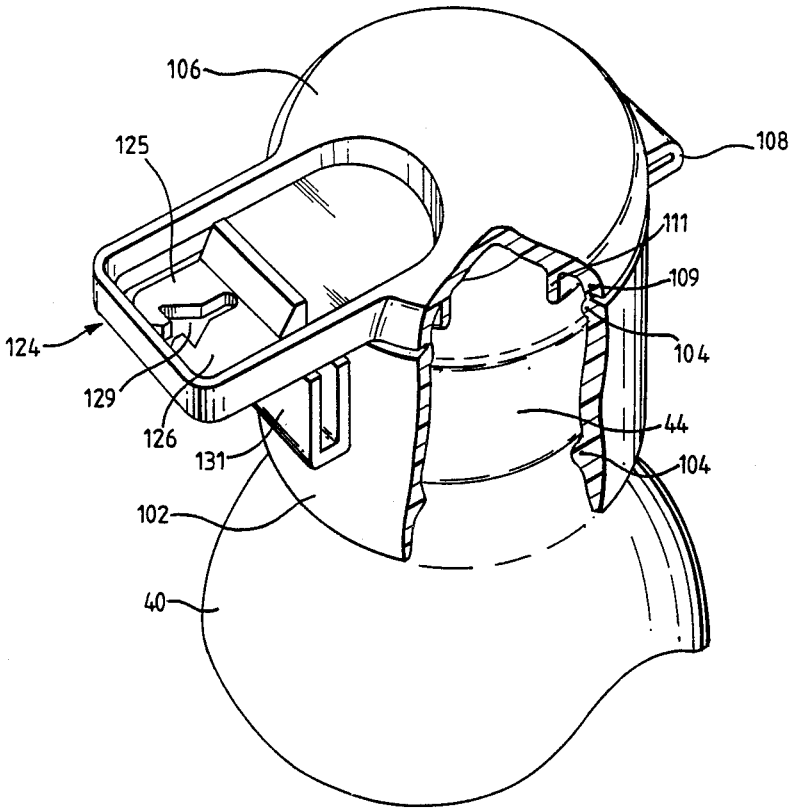
FIGS. 3*a* to 3*d* show a second embodiment of the invention, the views corresponding respectively to FIGS. 1*b* to 1*e.

FIGS. 3*a* to 3*d* show a further embodiment of the invention. The vial, bung and overseal are the same as in the embodiment of FIGS. 1*a* to 1*e*, and are denoted by the same reference numbers. Some of the elements of the closure correspond substantially to the corresponding elements in the embodiment of FIGS. 1*a* to 1*e* and where this is the case they are denoted by the same reference numerals but with the addition of 100. Unlike the closure of FIGS. 1*a* to 1*e*, the closure of FIGS. 3*a* to 3*d* is moulded in a closed condition. FIG. 3*a* shows the closure as moulded and applied to the vial 40. It will be seen that the collar 102 is held on the vial by two inwardly directed annular beads 104 and 104*a*, which replace the ring 4. In the condition shown in FIG. 3*a* the cap 106 is secured to the collar 102 not only by a hinge 108 but also by a continuous breakable membrane 109. The underside of the cap carries an annular ring 111 which provides for improved sealing between the cap and the aluminum over-seal particularly when the closure is re-sealed after being initially opened, i.e. in the condition shown in FIG. 3*c*. The cap carries a locking member 124 which is arranged to be engageable with the corresponding locking member 122 on the wall of the collar 102. The locking member 124 comprises an L-shaped locking element 125 which is pivotally mounted in an aperture in the locking member 124 by a membrane-like hinge 127. The locking element 125 comprises an arm 126 having an arrow-aperture 129 formed therein. The locking member 122 comprises a U-shaped channel 131 with an arrow-shaped lug 133 formed between the walls of the channel. The arm 126 may, in an alternative configuration, have the arrow-shaped lug.

Figure 3B:
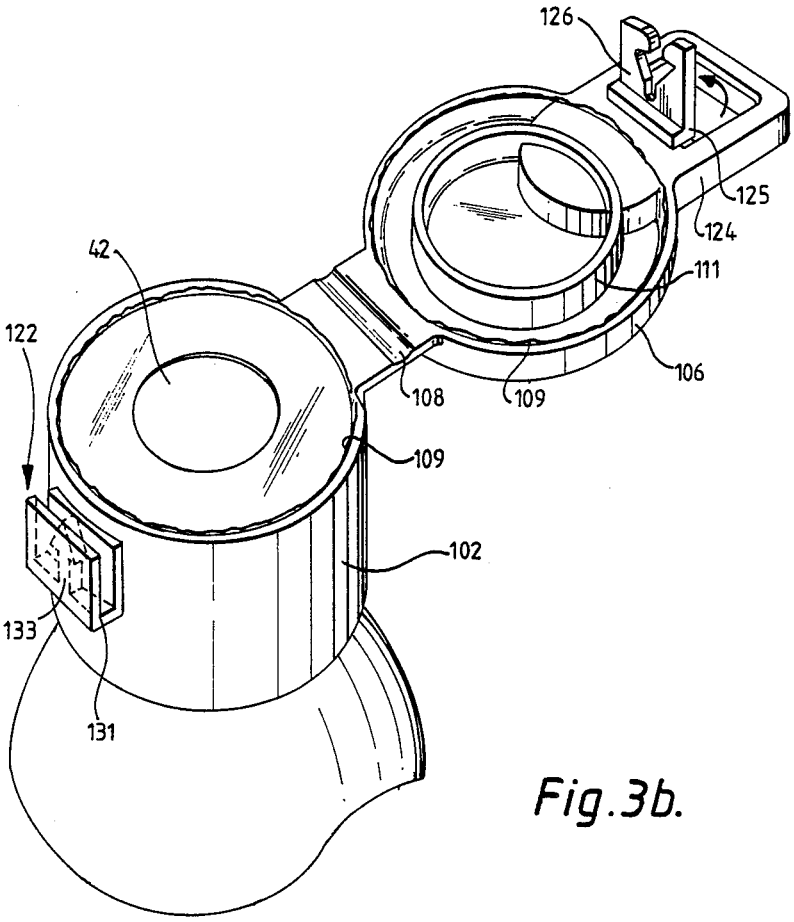

In the condition indicated in FIG. 3*a* the locking element 125 lies parallel to the plane of the upper surface of the cap and thus does not engage the locking member 122. The cap 106 is held in position purely by the membrane 109. When it is desired initially to open the closure the user grasps the locking member 124 and lifts it upwardly, thus breaking the membrane 109. This condition is shown in FIG. 3*b*. The two broken portions of the membrane 109 can be seen in FIG. 3*b*.

Figure 3C:
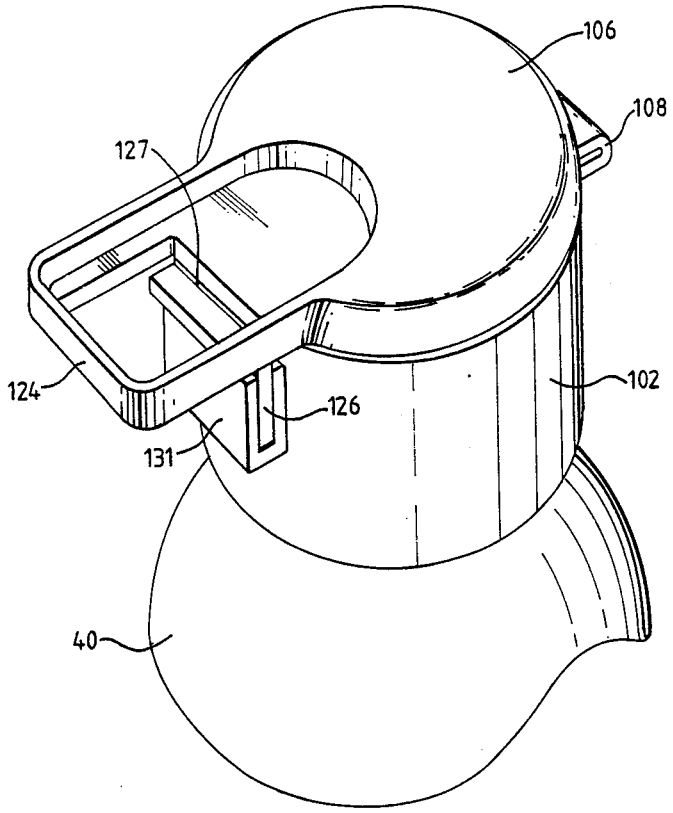

When it is desired to re-close the closure the locking element 125 is pivoted about the hinge 127 to bring it into the position shown in FIG. 3*b*, with the arm 126 orientated vertically. The cap is then pivoted about the hinge 108 to cause the arm 126 to pass between the opposed side walls of the U-shaped channel 131 to snap the arrow-aperture 129 into position about the corresponding arrow-shaped catch 133. This re-closed condition is shown in FIG. 3*c*.

Figure 3D:
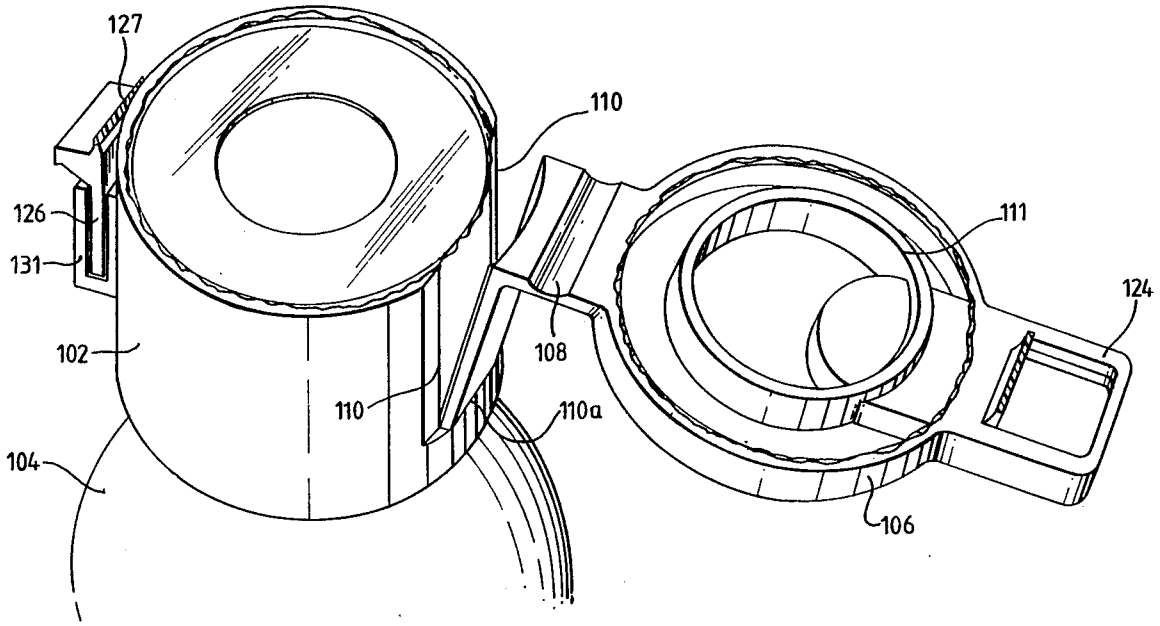

When it is desired to re-open the closure the user once again grasps the locking member 124 and lifts it upwardly, which causes the membrane-like hinge 127 to break. This is shown in FIG. 3*d*. As is also shown in that figure, if it is desired to remove the cap completely from the skirt a downward force is exerted on the cap to cause breaking to take place along two vertical lines of weakness 110 and an interconnecting horizontal line of weakness 110*a*. Although the collar is not then completely split as it is in the embodiment of FIGS. 1*a* to 1*e* it is split sufficiently to enable it to be manipulated off the vial.

Figure 4A:
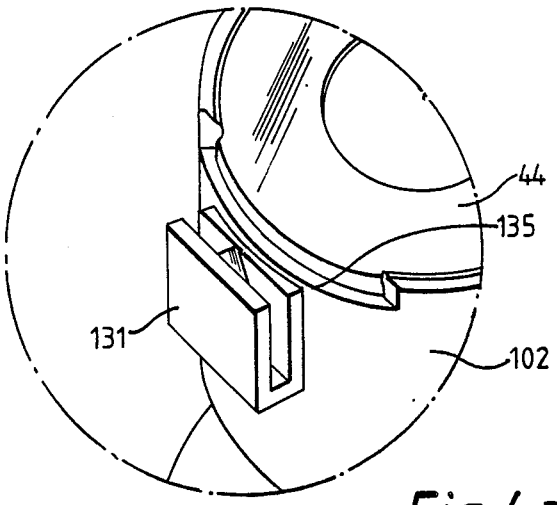
* and FIGS. 4*a* and 4*b* show details of two modifications of the closure of FIGS. 3*a* to 3*d.*
Figure 4B:
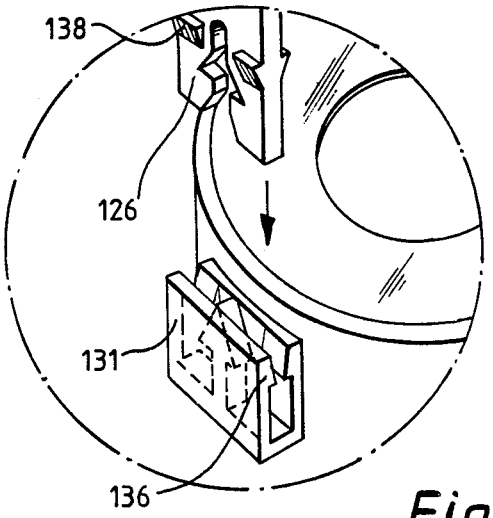

FIGS. 4*a* and 4*b* show two modifications to the embodiment of FIGS. 3*a* to 3*d*. FIG. 4*a* shows the provision of a step 135 in the upper edge of the collar 102 to allow drainage of swabbing liquid. The step could be located elsewhere around the circumference of the collar, and there could be more than one step. FIG. 4*b* shows a modified locking arrangement in which in addition to the interlocking arrow-shaped components co-operating triangular beads 136 and 138 are provided respectively on the inner walls of the U-shaped channel 131 and the side of the arm 126. This provides for increased reliability in locking when the closure is reclosed.

What we claim is:

1. A closure for a container, the closure comprising a first part to be mounted on the container and a second part pivotally connected to the first part, wherein first tamper-evident means are provided between the two parts and wherein a catch is provided on one of the parts, the catch being movable relative to the said one part between a first position in which it does not connect with the other part and a second position in which it can connect with the other part, the catch in its second position forming second tamper-evident means.

2. A closure according to claim 1, wherein the catch is provided on the second part.

3. A closure according to claim 2, wherein the catch is pivotable between its said two positions.

4. A closure according to claim 3, wherein the catch comprises a breakable locking arm.

5. A closure according to claim 4, wherein the first tamper-evident means comprises at least one breakable locking arm.

6. A closure according to claim 4, wherein the first tamper-evident means comprises a breakable membrane between the two parts.

7. A closure according to claim 5, wherein the first tamper-evident means comprises two spaced apart breakable arms, the pivotable locking arm which forms the catch being located in the space between the breakable locking arms.

8. A closure according to claim 6, wherein the catch locking arm includes an arrow-shaped aperture or lug.

9. A closure according to claim 4, wherein the second part comprises an elongate recess for the thumb of a user and the catch comprises a protrusion which extends into the recess, whereby movement of the user's thumb along the recess pivots the catch into its second position.

10. A closure according to claim 4, wherein the first part has at least one line of weakness which enables it to be removed from the container.

* * * * *